United States Patent [19]

Randall

[11] Patent Number: 4,971,072

[45] Date of Patent: Nov. 20, 1990

[54] EAR BRACE

[76] Inventor: Carol C. Randall, 1242 Redondo Blvd., Los Angeles, Calif. 90019

[21] Appl. No.: 350,397

[22] Filed: May 11, 1989

[51] Int. Cl.[5] ..... A61F 11/14

[52] U.S. Cl. ..... 128/857; 2/174

[58] Field of Search ..... 128/857, 864–868; 132/212; 2/174; D28/10, 73, 99, 11

[56] References Cited

U.S. PATENT DOCUMENTS

| | | | |
|---|---|---|---|
| 1,255,800 | 2/1918 | Schurmeier | 2/174 |
| 1,651,650 | 12/1927 | Walsh | 2/174 |
| 1,683,928 | 9/1928 | Smyth | 2/174 |
| 1,772,223 | 8/1930 | Pence | 2/174 |
| 1,851,455 | 3/1932 | Sjostrand | 2/174 |
| 1,878,397 | 9/1932 | Hekler et al. | 2/174 |
| 1,909,856 | 5/1933 | Dolder | 2/174 |
| 1,988,011 | 1/1935 | Margolith | 2/174 |
| 2,198,546 | 4/1940 | Lover et al. | 2/174 |
| 2,240,391 | 4/1941 | Corn | 2/174 |
| 3,303,514 | 2/1967 | Wessels | 2/174 |
| 3,354,471 | 11/1967 | Longo | 2/174 |

*Primary Examiner*—Edgar S. Burr
*Assistant Examiner*—Kimberly L. Asher

[57] ABSTRACT

A brace to hold the ears in a position folded forward and down having a pair of like spring clips attached with rivets to either end of an elastic strap.

1 Claim, 1 Drawing Sheet

EAR BRACE

This invention is a device to hold the ears in a position folded forward and down to allow unobstructed access to the hairline area behind the ears. Clips at either end of the device attach to the ears and a strap between them, worn under the chin, provides tension to hold the ears gently in place.

The invention is intended particularly for use when applying preparations to the hair that should not contact the skin such as chemical relaxers, permanents or dyes. As these preparations (which are applied with gloved hands) can burn or discolor the skin, before application the hairline and ears are coated with a protective substance such as petroleum jelly. But this is minimal protection. If the preparation contacts any coated area during application that area must be wiped clean and more coating applied. The ears present an obstacle as they protrude so near the hairline. Current practice requires that each ear be held in turn in a folded position with one hand while the preparation is applied to the hairline behind the ear with the other hand. When each ear is released it must be inspected for any contact with the preparation, wiped clean and re-coated if necessary, then diligently avoided during the rest of the application process.

The ear brace essentially removes the ears as obstacles by holding them simultaneously away from the hairline while freeing both hands to attend to the application process.

This invention would be useful to the professional hairdresser or beautician applying preparations to the hair of their clients and perhaps even more useful to the inexperienced individual applying over-the-counter preparations to their own hair at home. The ear brace is easy to operate, comfortable and reusable.

The invention is illustrated in the accompanying figures.

Figure 1:
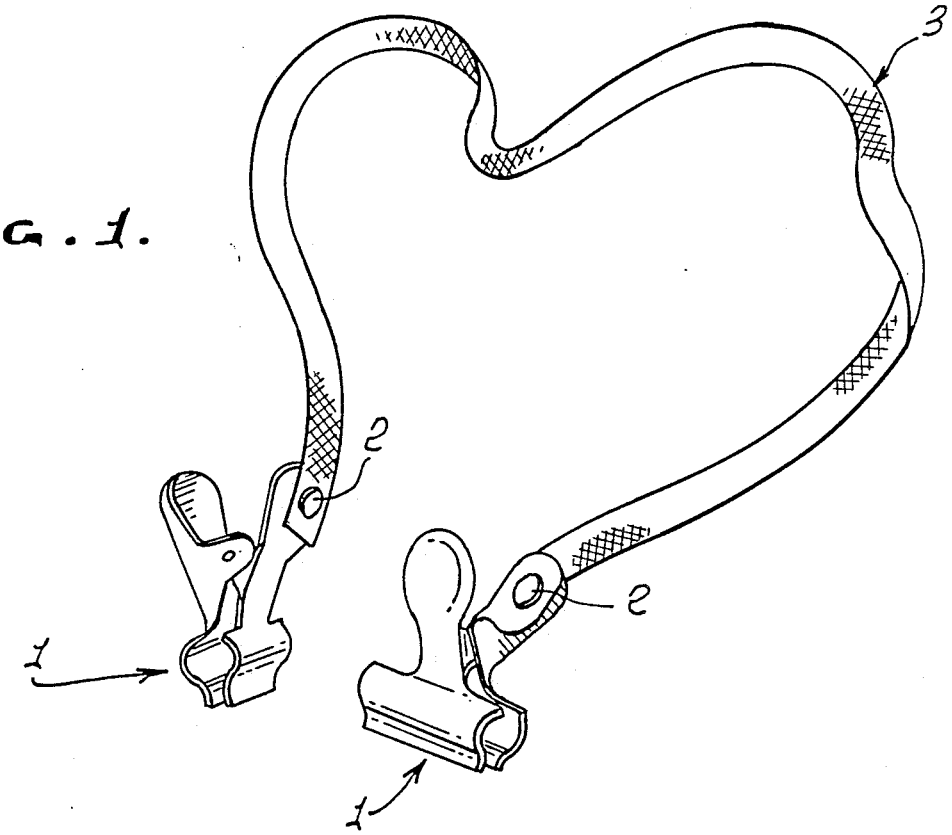

FIG. 1: a perspective drawing of the invention

Figure 2:
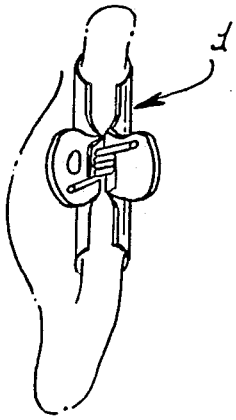

FIG. 2: a detail showing how the clip attaches to the ear

Figure 3:
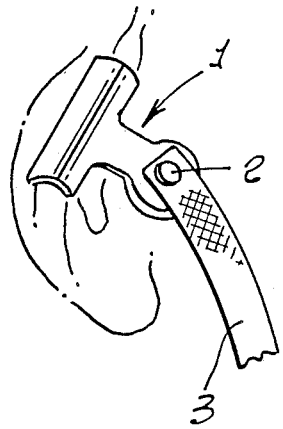

FIG. 3: a detail showing the position in which the device holds the ear

The embodiment of the invention illustrated in FIG. 1 consists of a pair of like 23 mm spring clips attached with rivets to either end of an elastic strap measuring 24 cm by 6 mm.

OPERATION

A clip at one end of the device is attached to the upper portion of one ear as illustrated in FIG. 2. The strap is then drawn under the chin and the opposite clip attached to the opposite ear in the same fashion. The tension created by the strap holds each ear in position as detailed in FIG. 3. Padding, i.e. cottonballs, may be used between the clips and ears for added comfort.

Scope

Although the description above contains a number of specificities these should not be construed as limiting the scope of the invention but as merely illustrating the presently preferred embodiment. For example, variations can include clips of another size or design, an adjustable strap, etc. Thus the scope of the invention should be determined by the appended claims and their legal equivalents rather than by the example given.

I claim:

1. An ear brace comprising means for folding the user's ears away from the user's scalp and towards the user's face; said folding means comprising means for clasping a user's ears;

said clasping means comprising two clip members, one each engaging each of a user's ears;

said clasping means only engaging the upper marginal surface of the ear, and not enclosing the user's ear;

and strap means;

said strap means connecting said clip members;

said strap means extending from a first clip member on one of a user's ears, extending under the user's chin, and grasping the other clip member on the other ear of the user.

* * * * *